US009603424B2

(12) United States Patent
Lai

(10) Patent No.: US 9,603,424 B2
(45) Date of Patent: Mar. 28, 2017

(54) LUGGAGE CASE WITH TWO ZIPPER POCKETS

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 0 days.

(21) Appl. No.: 15/057,016

(22) Filed: Feb. 29, 2016

(65) Prior Publication Data

US 2016/0174673 A1 Jun. 23, 2016

Related U.S. Application Data

(63) Continuation-in-part of application No. 14/447,641, filed on Jul. 31, 2014, now abandoned.

(51) Int. Cl.

| | |
|---|---|
| ***A45C 3/00*** | (2006.01) |
| ***A45C 5/06*** | (2006.01) |
| ***A45C 5/03*** | (2006.01) |
| ***A45C 13/10*** | (2006.01) |
| ***A45C 5/14*** | (2006.01) |

(52) U.S. Cl.

CPC ..... *A45C 5/06* (2013.01); *A45C 5/03* (2013.01); *A45C 5/14* (2013.01); *A45C 13/103* (2013.01)

(58) Field of Classification Search

CPC .. A45C 3/00; A45C 13/02; A45C 5/00; A45C 3/004; A45C 3/02

USPC ..... 190/111, 100, 109, 112, 125, 18 A, 115, 190/124; 206/320, 315.1; D3/279, 276, D3/273, 283, 284, 285

See application file for complete search history.

(56) References Cited

U.S. PATENT DOCUMENTS

| | | | | |
|---|---|---|---|---|
| 5,676,223 | A * | 10/1997 | Cunningham | A45C 3/004 190/109 |
| 5,944,155 | A * | 8/1999 | Geary | A45C 5/06 150/111 |
| 6,059,079 | A * | 5/2000 | Krulik | A45C 5/06 190/111 |
| 6,102,172 | A * | 8/2000 | Dercole | A45C 5/005 190/109 |
| 6,213,266 | B1 * | 4/2001 | Hollingsworth | A45C 5/14 150/111 |
| 6,536,568 | B1 * | 3/2003 | Tong | A45C 13/30 190/101 |
| 6,953,110 | B2 * | 10/2005 | Santy | A45C 5/06 190/111 |
| D525,029 | S * | 7/2006 | Teitloff | D3/258 |
| 2004/0154889 | A1 * | 8/2004 | Gifford | A45C 5/14 190/18 A |

* cited by examiner

*Primary Examiner* — Fenn Mathew
*Assistant Examiner* — Cynthia Collado
(74) *Attorney, Agent, or Firm* — Bruce Stone LLP; Joseph Bruce

(57) ABSTRACT

A luggage case with two zipper pockets includes: a case body, a first zipper pocket and a second zipper pocket. The front surface of the luggage case body is a multi-stepped surface, and the first and second zipper pockets are provided on the front surface of different levels, which can prevent interference of the first zipper with the second zipper, when the two zippers move to the boundary between the two zipper pockets. Besides, since the front surface of the luggage case body is a multi-stepped surface, so as to prevent high moment of force from acting on the second zipper pocket, thus extending the life of the luggage case.

5 Claims, 6 Drawing Sheets

LUGGAGE CASE WITH TWO ZIPPER POCKETS

This application is a continuation in part of U.S. patent application Ser. No. 14/447,641, which claims the benefit of the earlier filing date of Jul. 31, 2014. Claims 1-6 are new.

BACKGROUND OF THE INVENTION

Field of the Invention

The present invention relates to a luggage case, and more particularly to a luggage case with two zipper pockets.

Description of the Prior Art

Normally, a pocket structure on a luggage case is sealed with a zipper, and a single pocket can be opened or closed with a zipper very easily. However, things will be different when there are two pockets sealed respectively with a zipper on the same mounting surface 10. As shown in FIGS. 1 and 2, for example, a first pocket 11 and a second pocket 12 are respectively sealed with a first zipper 111 and a second zipper 121. The first and second zippers 111, 121 are located at a first height H1 and a second height H2, respectively with respect to the mounting surface 10, and the first height H1, the second height H2 are equal to each other. Namely, the travel paths of the first and second zippers 111, 121 are located at the same height, which will cause interference of the two zippers with each other, when the sliders of the two zippers move to the boundary between the two pockets.

As shown in FIGS. 3 and 4, a bowling ball carrier 20 includes a main pocket body 21 which includes an open end 211 which is connected to a front surface 22 by a main zipper 212. The front surface 22 is a flat surface and provided with a first secondary pocket 23 and a second secondary pocket 24. The first secondary pocket 23 has one side provided with a first open end 231 which can be opened and closed by a first zipper, and has another end connected to the front surface 22. The second secondary pocket 24 has one end provided with a second open end 241 which can be opened and closed by a second zipper 242, and has another end connected to the front surface 22. The first secondary pocket 23 has a first height h1 with respect to the front surface 22, the second secondary pocket 24 has a second height h2 with respect to the front surface 22, and h1 is different from h2.

The first and second zippers 232, 242 do not interfere with each other. However, the main pocket body 21 includes the open end 211 formed at one end thereof, and only has a single inner space for storage of goods. Therefore, all goods have to be put together in the main pocket body 21 without sorting, which makes it inconvenience for the user to take out the desired goods.

Besides, the first and second secondary pockets 23, 24 with different heights (h1, h2) are disposed on the same front surface 22, if h2>h1, the height h2 becomes the length of arm of force of the second secondary pocket 24 with respect to the front surface 22 after the second secondary pocket 24 carries goods, and a very large moment of force will be produced after goods are put in the second secondary pocket 24, and as a result, the second secondary pocket 24 is likely to be deformed or torn.

The present invention has arisen to mitigate and/or obviate the afore-described disadvantages.

SUMMARY OF THE INVENTION

The primary objective of the present invention is to provide a luggage case with two zipper pockets, which is capable of overcoming the interference of two zippers of the two zipper pockets with each other, and further capable of extending the life of the luggage body.

To achieve the above objective, a luggage case with two zipper pockets in accordance with the present invention comprises: a case body, a first zipper pocket and a second zipper pocket.

The case body includes a first lateral shell and a second lateral shell pivoted to each other, the first lateral shell includes a first compartment, and the second lateral shell includes a second compartment, wherein the first and second lateral shells are opened and closed to each other by a case body zipper, the first lateral shell includes a front surface which is a multi-stepped surface, the front surface includes a first connecting surface, a first transition surface, and a second connecting surface, wherein the first connecting surface and the second connecting surface are parallel to one another and located at different levels, the first transition surface is connected between the first and second connecting surfaces at an angle;

the first zipper pocket includes a first bottom shell, and a first top shell and a first zipper disposed between the first bottom and top shells, wherein the first bottom shell is connected to the first connecting surface, the first zipper servers to close and open the first bottom and top shells, and is located within an area perpendicular to the first transition surface; and the second zipper pocket includes a second bottom shell, a second top shell, and a second zipper disposed between the second bottom and top shells, wherein the second bottom shell is connected to the second connecting surface, and the second zipper servers to open or close the second bottom and top shells.

The front surface of the luggage case body is a multi-stepped surface, and the first and second zipper pockets are provided on the front surface of different levels, which can prevent interference of the first zipper with the second zipper, when the two zippers move to the boundary between the two zipper pockets. Besides, since the front surface of the luggage case body is a multi-stepped surface, so as to prevent high moment of force from acting on the second zipper pocket, thus extending the life of the luggage case.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
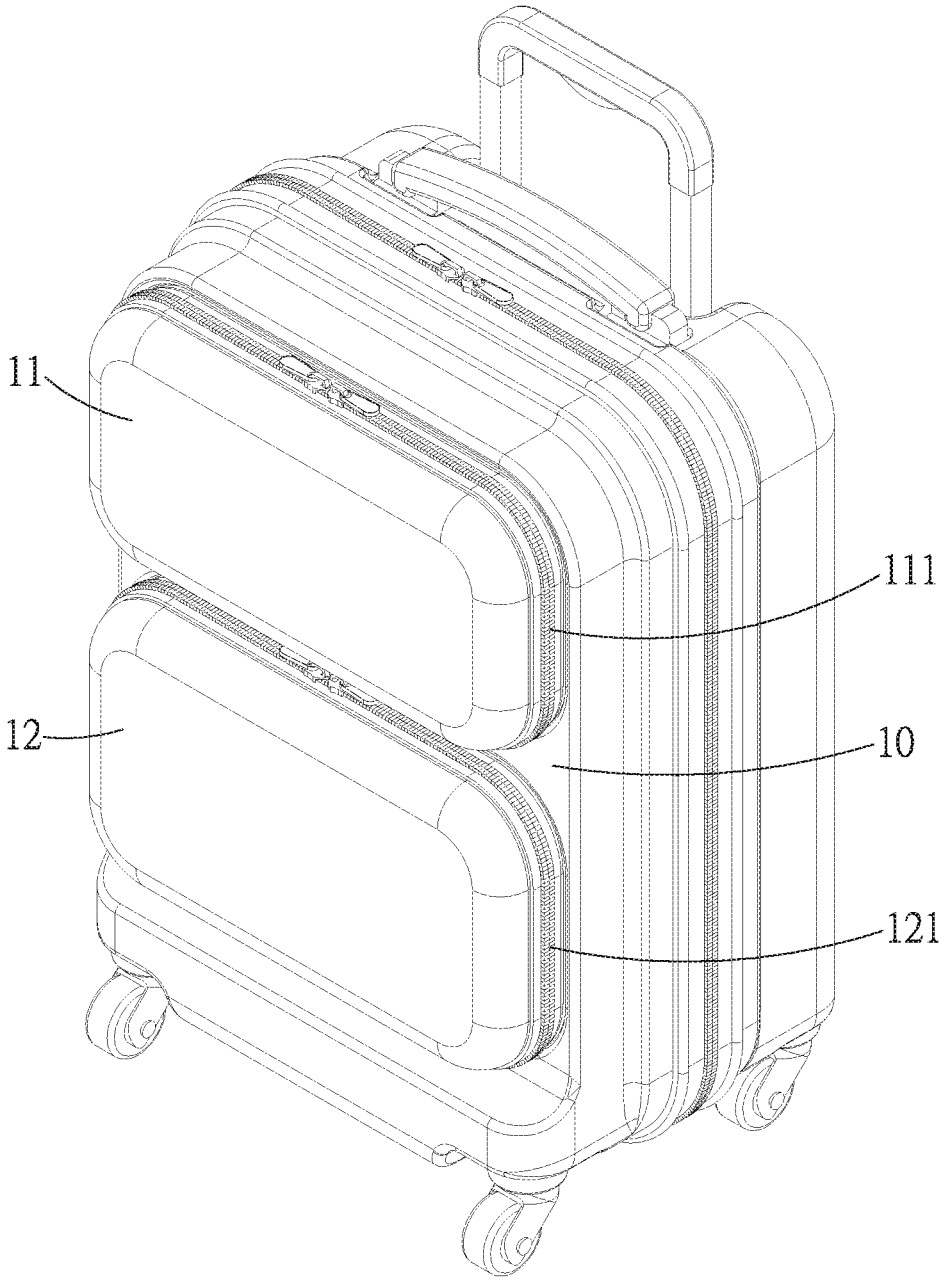
PRIOR ART FIG.1
FIG. 1 shows a conventional luggage case with two zipper pockets.
Figure 2:
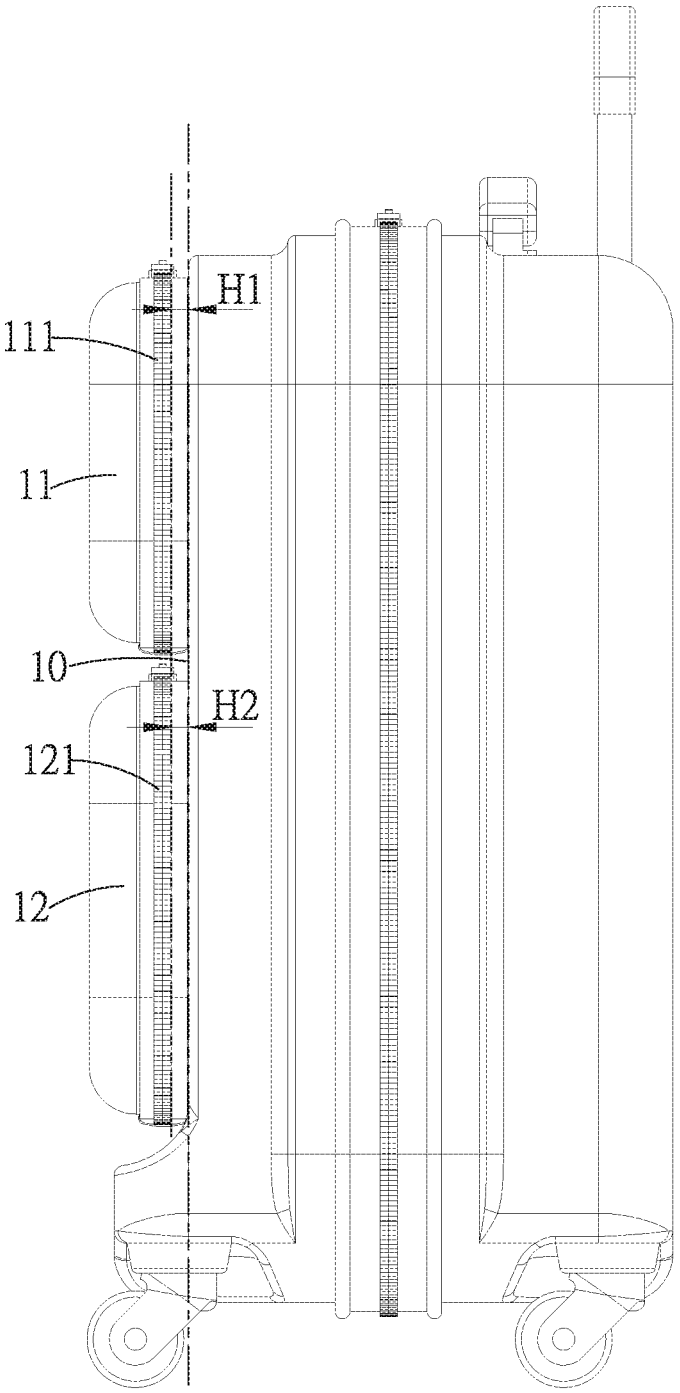
PRIOR ART FIG.2
FIG. 2 is a side view of FIG. 1.
Figure 3:
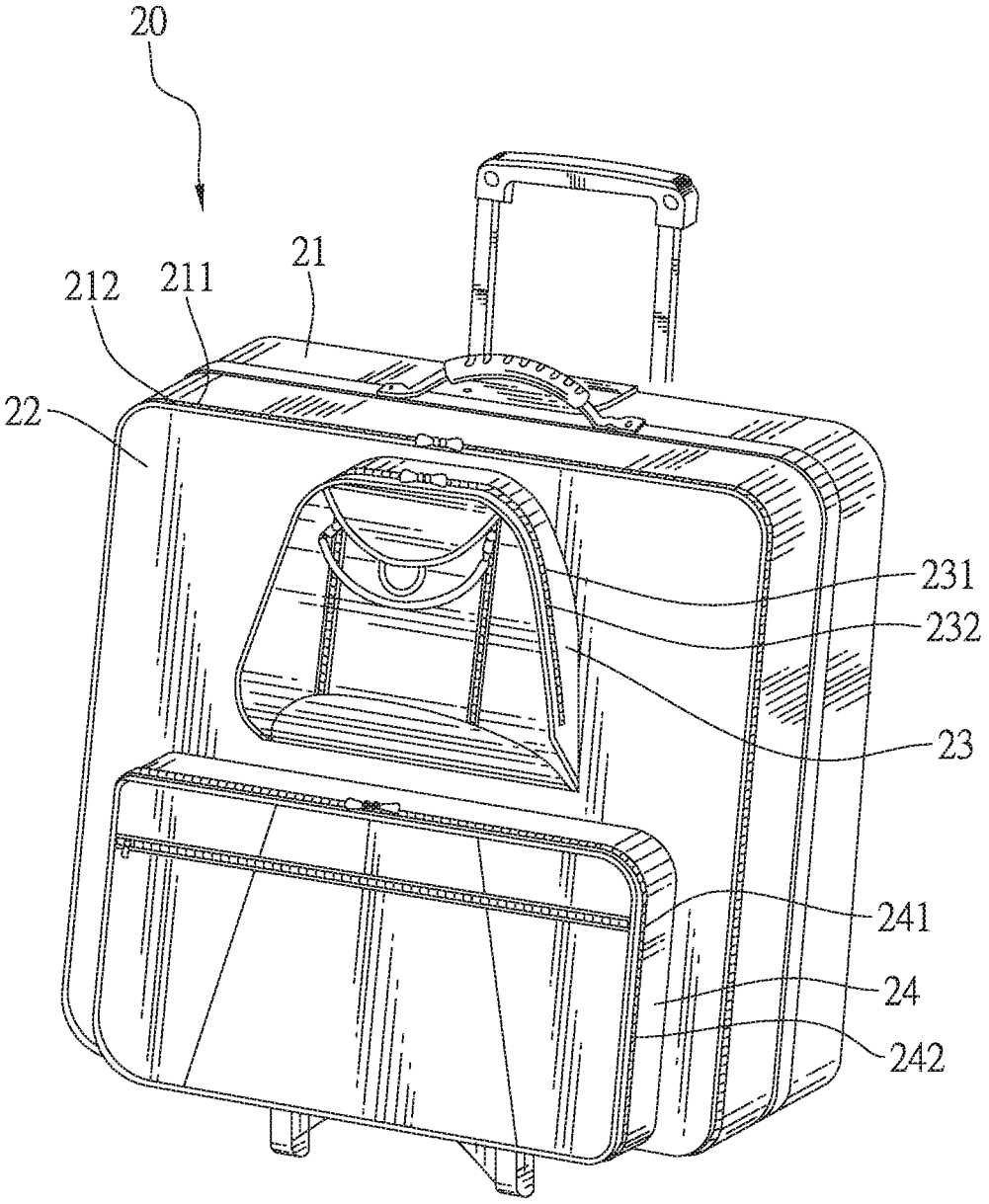
PRIOR ART FIG.3
FIG. 3 shows a conventional bowling ball carrier.
Figure 4:
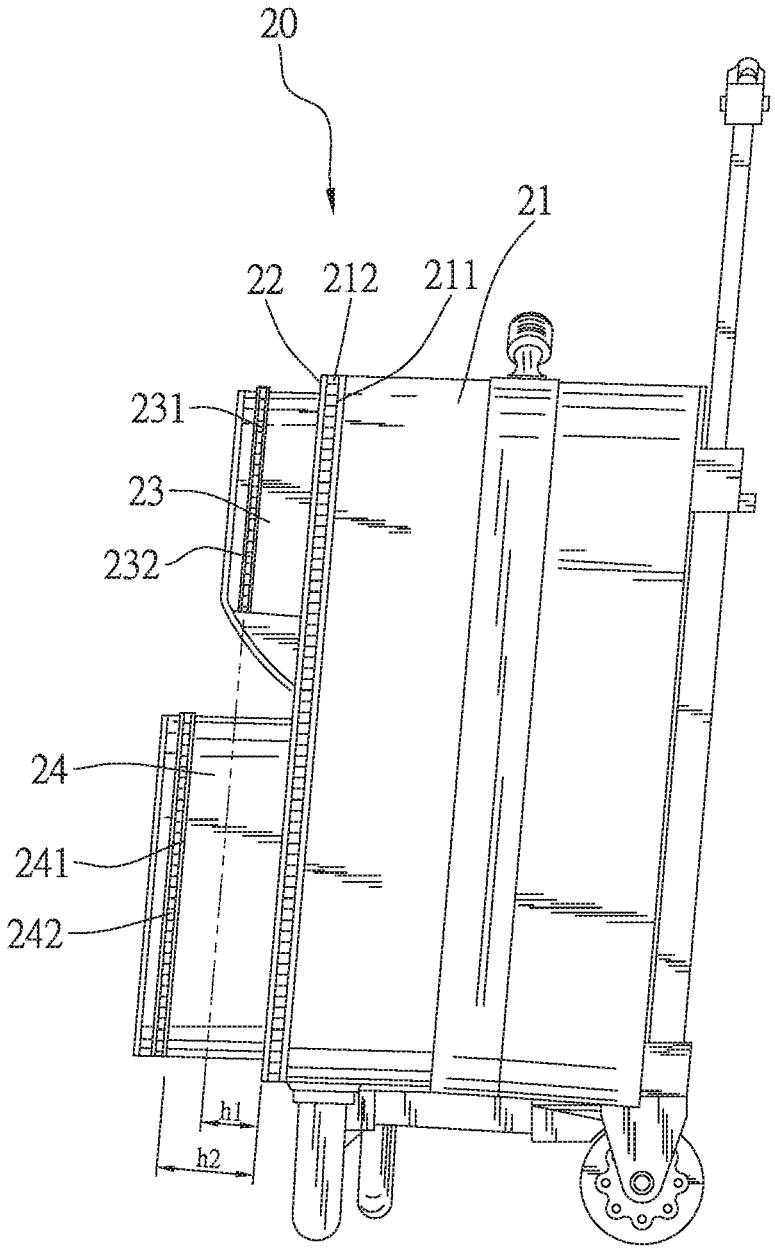
PRIOR ART FIG.4
FIG. 4 is a side view of FIG. 3.
Figure 5:
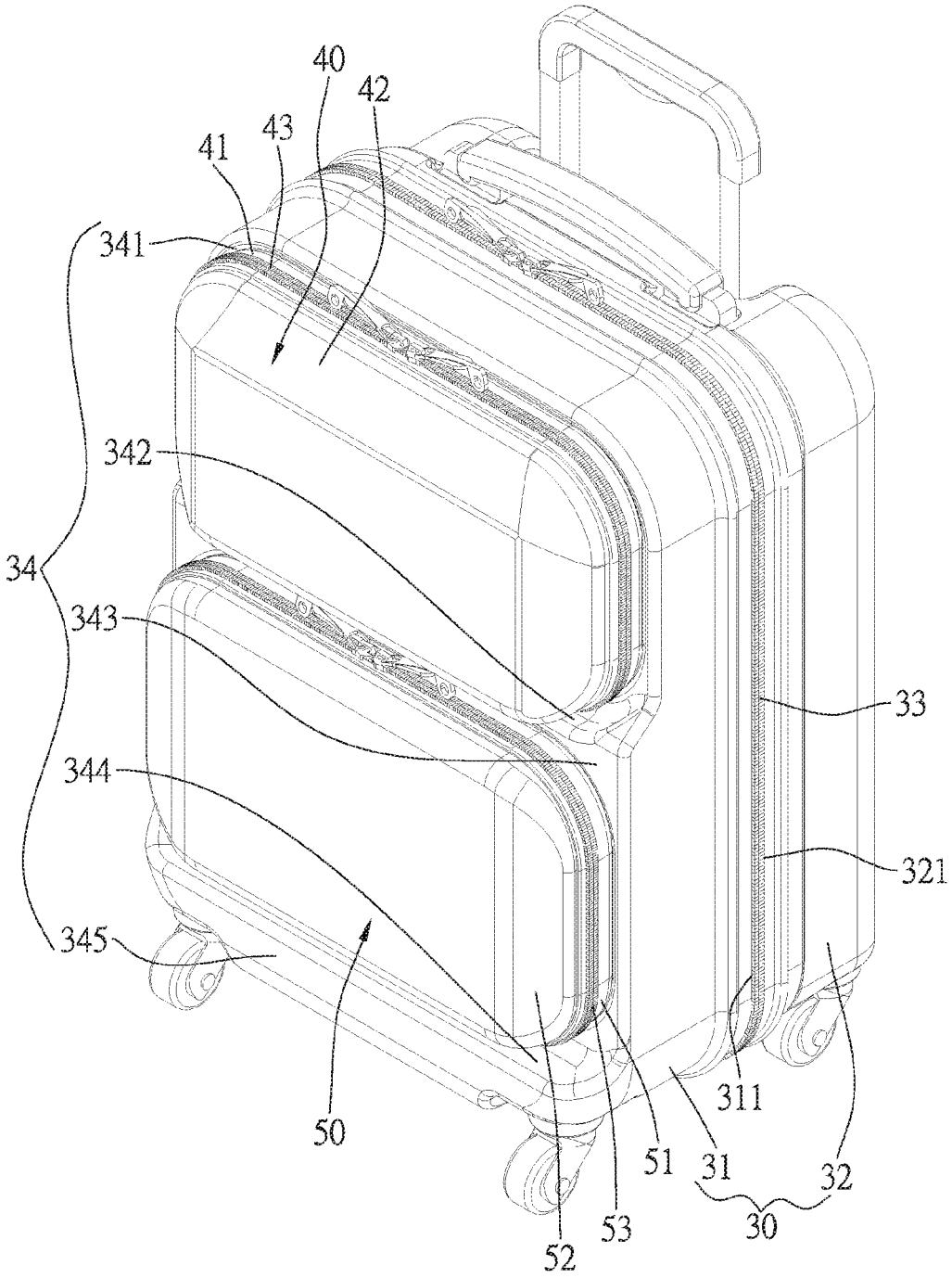
FIG. 5 is a perspective view of a luggage case with two zipper pockets in accordance with a preferred embodiment of the present invention.
Figure 6:
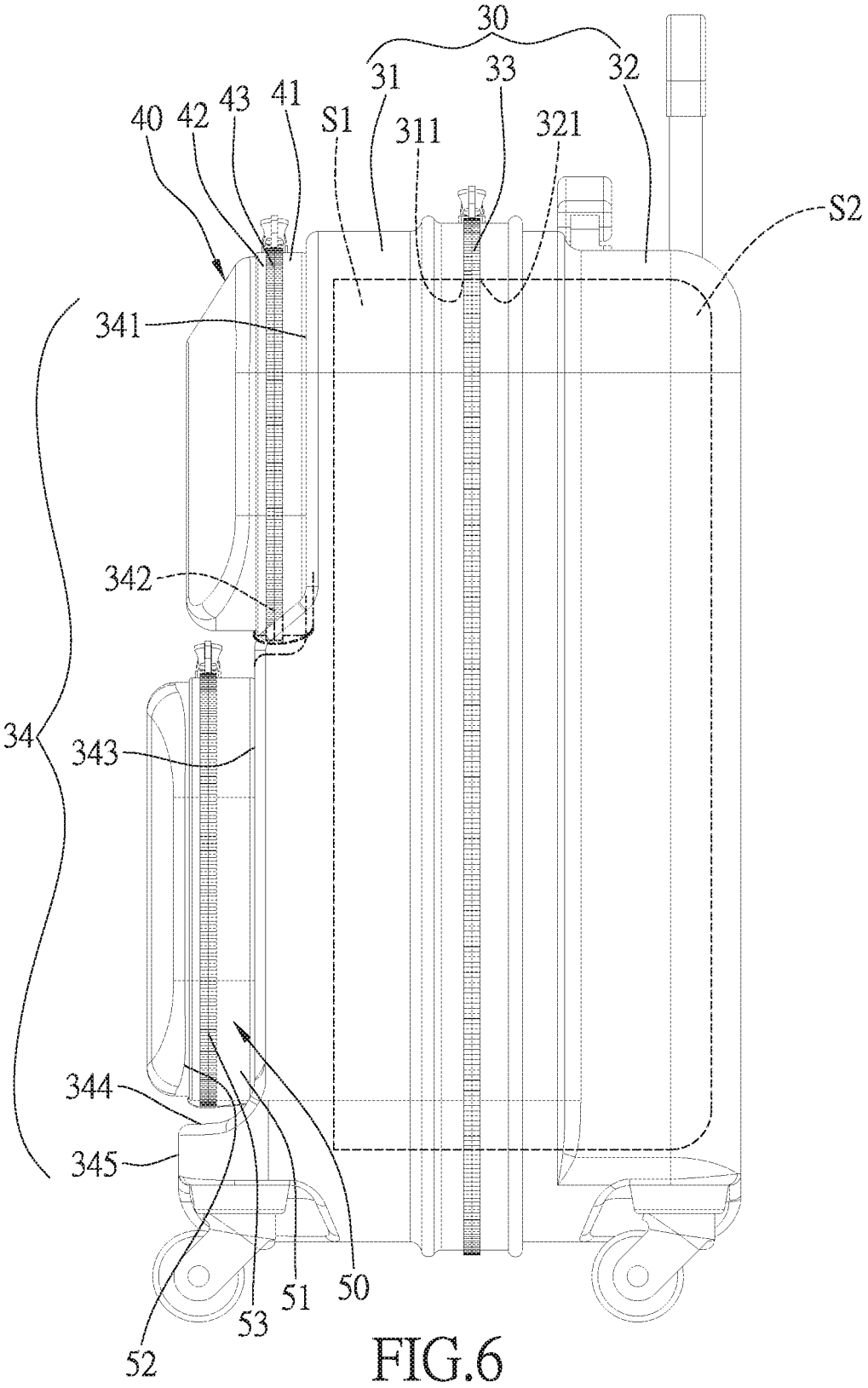
FIG. 6 is a side view of FIG. 5.

Referring to FIGS. 5 and 6, a luggage case with two zipper pockets in accordance with the preferred embodiment of the present invention comprises: a case body 30, a first zipper pocket 40 and a second zipper pocket 50.

The case body 30 includes a first lateral shell 31 and a second lateral shell 32 which are pivoted to each other. The first lateral shell 31 includes a first compartment S1, and a first open mouth 311 at one side thereof. The second lateral shell 32 includes a second compartment S2 and a second open mouth 321 at one side thereof. The first open mouth 311 of the first lateral shell 31 and the second open mouth 321 of the second lateral shell 32 are located opposite each other, and can be opened and closed to each other by a case body zipper 33. When the case body zipper 33 is closed, the first open mouth 311 of the first lateral shell 31 and the second open mouth 321 of the second lateral shell 32 are close and in communication with each other. Another side of the first lateral shell 31 opposite the first open mouth 311 is a front surface 34 which is a multi-stepped surface. In this embodiment, the front surface 34 includes a first connecting surface 341, a first transition surface 342, a second connecting surface 343, a second transition surface 344 and an extending protection surface 345. The first connecting surface 341, the second connecting surface 343 and the extending protection surface 345 are parallel to one another and located at different levels. The first transition surface 342 is connected between the first and second connecting surfaces 341, 343 at an angle. The second transition surface 344 is connected between the second connecting surface 343 and the extending protection surface 345. In this embodiment, the first transition surface 342 extends in a direction perpendicular to the first and second connecting surfaces 341, 343, and the second transition surface 344 extends in a direction perpendicular to the second connecting surface 343 and the extending protection surface 345. The height of the front surface 34 increases in the sequence: the first connecting surface 341, the second connecting surface 343, and the extending protection surface 345.

The first zipper pocket 40 is disposed at the first connecting surface 341 of the front surface 34, and includes: a first bottom shell 41, and a first top shell 42 and a first zipper 43 disposed between the first bottom and top shells 41, 42. The first bottom shell 41 is connected to the first connecting surface 341, the first zipper 43 servers to close and open the first bottom and top shells 41, 42, and is located within an area perpendicular to the first transition surface 342.

The second zipper pocket 50 is disposed on the second connecting surface 343 of the front surface 34, and includes: a second bottom shell 51, a second top shell 52, and a second zipper 53 disposed between the second bottom and top shells 51, 52. The second bottom shell 51 is connected to the second connecting surface 343. The second zipper 53 servers to open or close the second bottom and top shells 51, 52, and is located within an area perpendicular to the second transition surface 344.

When in use, the combination of the first and second lateral shells 31, 32 of the case body 30 can create the first and second compartments S1, S2 which can be provided for storage of goods, and can be opened or closed by the case body zipper 33. With the case body zipper 33, the user can easily access the first and second compartments S1, S2 via the first and second open mouths 311, 321.

In addition to the first and second compartments S1, S2 of the case body 30, the first and second zipper pockets 40 and 50 disposed the front surface 34 of the first lateral shell 31 can also be provided for storage of goods, which improves the storage capacity of the case body 30.

It is to be noted that the first and second zipper pockets 40 and 50 are disposed differently at the first and second connecting surfaces 341, 343 which are located at different levels (heights), which can prevent interference of the first zipper 43 with the second zipper 53, when the two zippers move to the boundary between the two zipper pockets 40, 50.

Since the height difference of the first and second zippers 43, 53 is based on the first and second connecting surfaces 341, 343 of different levels and is not caused by the second zipper 53 alone, although the second zipper 53 is higher than the first zipper 43, the moment of force applied to the second zipper pocket 50 is not increased, so as to prevent the second zipper pocket 50 from excessively deformation or even being torn when subjected to a large moment of force.

Furthermore, the first zipper 43 is located within an area perpendicular to the first transition surface 342, and the second zipper 53 is located within an area perpendicular to the second transition surface 344, namely, the first and second zippers 43, 53 are located within the first and second transition surfaces 342, 344, respectively, so that the second connecting surface 343 is higher than the first zipper 43, and the first and second zippers 43, 53 are restricted by the second connecting surface 343 and the extending protection surface 345, so as to prevent the structurally weakest portion of case body where the first and second zippers 43, 53 from direct impact, thus effectively extending the life the luggage case.

While we have shown and described various embodiments in accordance with the present invention, it is clear to those skilled in the art that further embodiments may be made without departing from the scope of the present invention.

What is claimed is:

1. A luggage case with two zipper pockets comprising: a case body with a first lateral shell and a second lateral shell pivoted to each other, the first lateral shell including a first compartment, and the second lateral shell including a second compartment, wherein the first and second lateral shells are opened and closed to each other by a case body zipper, the first lateral shell including a front surface which is a multi-stepped surface, the front surface including a first connecting surface, a first transition surface, and a second connecting surface, wherein the first connecting surface and the second connecting surface are parallel to one another and located at different levels, the first transition surface is connected between the first and second connecting surfaces at an angle; a first zipper pocket including a first bottom shell, and a first top shell and a first zipper disposed between the first bottom and top shells, wherein the first bottom shell is connected to the first connecting surface, the first zipper serves to close and open the first bottom and top shells, and is located within an area perpendicular to the first transition surface; and a second zipper pocket including a second bottom shell, a second top shell, and a second zipper disposed between the second bottom and top shells, wherein the second bottom shell is connected to the second connecting surface, and the second zipper servers to open or close the second bottom and top shells; and wherein the front surface further includes a second transition surface and an extending protection surface, the first connecting surface, the second connecting surface and the extending protection surface are parallel to one another and located at different levels, the second transition surface is connected between the second connecting surface and the extending protection surface, and the second zipper is located within an area perpendicular to the second transition surface.

2. The luggage case with two zipper pockets as claimed in claim 1, wherein the first transition surface extends in a direction perpendicular to the first and second connecting surfaces.

3. The luggage case with two zipper pockets as claimed in claim 1, wherein, and the second transition surface extends in a direction perpendicular to the second connecting surface and the extending protection surface.

4. The luggage case with two zipper pockets as claimed in claim 1, wherein the front surface includes the first connecting surface, the first transition surface, the second connecting surface, the second transition surface and the extending protection surface, and a height of the front surface increases in the sequence: the first connecting surface, the second connecting surface, and the extending protection surface.

5. The luggage case with two zipper pockets as claimed in claim 1, wherein the first lateral shell includes a first open mouth at one side thereof, the second lateral shell includes a second open mouth at one side thereof, the first open mouth of the first lateral shell and the second open mouth of the second lateral shell are located opposite each other, and capable of being opened and closed to each other by the case body zipper, when the case body zipper is closed, the first open mouth of the first lateral shell and the second open mouth of the second lateral shell are close to and in communication with each other, and the front surface is located at another side of the first lateral shell opposite the open mouth.

* * * * *